US012692649B2

(12) United States Patent
Weerawansa et al.

(10) Patent No.: US 12,692,649 B2
(45) Date of Patent: Jul. 28, 2026

(54) FABRIC ELEMENT

(71) Applicant: Stretchline Intellectual Properties Limited, Long Eaton (GB)

(72) Inventors: Liyana Arachchige Don Krishan Weerawansa, Kalapaluwawa (LK); A. Nalantha Priyaranga De Alwis, Keselwatta (LK); Wickrama Arachchige Sanjula Darshana Wickramasinghe, Henegama (LK); Piyal Ariyananda, Weera Mawatha (LK)

(73) Assignee: Stretchline Intellectual Properties Limited, Long Eaton (GB)

( * ) Notice: Subject to any disclaimer, the term of this patent is extended or adjusted under 35 U.S.C. 154(b) by 0 days.

(21) Appl. No.: 18/566,502

(22) PCT Filed: May 24, 2022

(86) PCT No.: PCT/GB2022/051299
§ 371 (c)(1),
(2) Date: Dec. 1, 2023

(87) PCT Pub. No.: WO2022/254181
PCT Pub. Date: Dec. 8, 2022

(65) Prior Publication Data

US 2024/0360618 A1 Oct. 31, 2024

(30) Foreign Application Priority Data

Jun. 2, 2021 (GB) ..... 2107870

(51) Int. Cl.
*D06H 1/02* (2006.01)
*D06P 1/673* (2006.01)
*D06P 5/20* (2006.01)

(52) U.S. Cl.
CPC ..... *D06H 1/02* (2013.01); *D06P 1/673* (2013.01); *D06P 5/2005* (2013.01); *D10B 2501/00* (2013.01)

(58) Field of Classification Search
None
See application file for complete search history.

(56) References Cited

U.S. PATENT DOCUMENTS 6,936,358 B2 8/2005 Kume et al.
2015/0336215 A1 11/2015 Quenzer et al.
(Continued)

FOREIGN PATENT DOCUMENTS

CN 1183292 6/1998
CN 104114199 A 10/2014
(Continued)

OTHER PUBLICATIONS

JP H111065A Machine Translation via EPO (Year: 1999).*
(Continued)

*Primary Examiner* — Laura C Powers
(74) *Attorney, Agent, or Firm* — Foley & Lardner LLP

(57) ABSTRACT

There is provided a fabric element (20) comprising a $TiO_2$ additive, the fabric element (20) including a mark (22) formed in or on a surface of the fabric element (20), wherein the mark (22) includes a lower titanium oxide than $TiO_2$.

8 Claims, 3 Drawing Sheets

(56) References Cited

U.S. PATENT DOCUMENTS

| | | | |
|---|---|---|---|
| 2015/0371564 | A1 | 12/2015 | Kakuda et al. |
| 2016/0128433 | A1 | 5/2016 | Downing et al. |
| 2016/0168779 | A1 | 6/2016 | Russell-Clarke et al. |
| 2018/0171540 | A1 | 6/2018 | Agarwal et al. |

FOREIGN PATENT DOCUMENTS

| | | | | |
|---|---|---|---|---|
| CN | 107419571 | | | 12/2017 |
| EP | 0 190 997 | | | 8/1986 |
| JP | H05-247319 | | | 9/1993 |
| JP | H10-016390 | | | 1/1998 |
| JP | H10-237319 | | | 9/1998 |
| JP | H11-001065 | | | 1/1999 |
| JP | H111065 | A | * | 1/1999 |
| JP | 2003-127540 | A | | 5/2003 |
| JP | 2004-042078 | A | | 2/2004 |
| JP | 2006-526086 | A | | 11/2006 |
| JP | 2008-246537 | | | 10/2008 |
| JP | 2010-536970 | A | | 12/2010 |
| JP | 2012-168417 | A | | 9/2012 |
| JP | 5639497 | | | 12/2014 |

OTHER PUBLICATIONS

International Search Report and Written Opinion issued on PCT/GB2022/051299 dated Aug. 5, 2022.

Optics and Laser Technology, Feb. 2013, vol. 45, pp. 147-153, https://doi.org/10.1016/j.optlastec.2012.07.012.

* cited by examiner

FABRIC ELEMENT

This invention relates to a fabric element and a method of manufacturing a fabric element.

It is known to print information on garments using various techniques such as screen printing or direct-to-garment printing.

According to a first aspect of the invention, there is provided a fabric element comprising a titanium dioxide ($TiO_2$) additive, the fabric element including a mark formed in or on a surface of the fabric element, wherein the mark includes a lower titanium oxide than $TiO_2$.

Typically $TiO_2$ in powder form (e.g. in nanoparticle form) is incorporated as an additive in fabrics to provide protection against ultraviolet (UV) radiation. Due to their size and colour, this provides a degree of opacity and whiteness depending on the amount of $TiO_2$ in the fabric.

The inventors have discovered that prolonged exposure of the $TiO_2$ to irradiation by a laser (e.g. a UV laser or a $CO_2$ laser), preferably under low or zero oxygen conditions when compared to the atmospheric oxygen level at sea level, results in the production of a mark that is distinguishable by colour from the rest of the fabric element by the naked eye. Using a laser to irradiate the $TiO_2$ not only enables the precise production of the mark to follow a desired shape and size but also only requires irradiation of a selected region of the surface of the fabric element. The formation of the mark in the fabric element of the invention is cost-effective and environmentally friendly because it does not require water and uses significantly less energy (up to 90% in some cases) than conventional ink-based printing methods that require the use of heat for drying or curing. Furthermore, the mark of the fabric element of the invention is more durable and colour-fast than conventional ink-based marks that fade over time, especially after undergoing multiple washes. Also, the formation of the mark in the fabric element of the invention has high reproducibility to ensure product-to-product consistency.

The mark may include any lower titanium oxide than $TiO_2$ such as, but not limited to, $Ti_2O_3$, $Ti_3O_5$ or $Ti_4O_7$.

The lower titanium oxide may be infused in fibres of the fabric element.

In embodiments of the invention, the fabric element may include 0.01 to 5.0 wt % $TiO_2$ additive. Preferably the fabric element includes 0.25 to 3.0 wt % $TiO_2$ additive.

In further embodiments of the invention, the fabric element may be made of a synthetic fabric material, such as polyester, polypropylene, polyether or nylon. Alternatively the fabric element may be made of a natural fabric material. The fabric element may be woven, non-woven, knit, washable or reusable.

In still further embodiments of the invention, the mark may include a letter, a word, a number, a symbol, a picture and/or a graphical element. Examples of the mark include, but are not limited to, a logo, a brand name, product information, manufacturer information, manufacturing information and cleaning information.

The invention is applicable to various types of fabric elements, non-limiting examples of which are described as follows.

The fabric element may be rigid, stretchable or elastic. The invention enables the creation of the mark on the surface of the fabric element that only affects the surface fabric material, such as fabric fibres, with slight damage to the fabric material and without negatively affecting its stretchability or elasticity that affects its end use.

The fabric element may be a label or may form part of a label. In such embodiments, the mark may be or may include product information, manufacturer information, manufacturing information and/or cleaning information. The invention is particularly useful for mass manufacturing of labels to provide economies of scale while enabling the formation of marks with high legibility.

The fabric element may be a garment or may form part of a garment. The fabric element of the invention is applicable to a wide range of garments. For example, the fabric element may be a waistband or may form part of a waistband. The fabric element may be, or may form part of, a bra strap, a bra cup, a wrist band, a head band, a shirt or other apparel. Alternatively the fabric element may be, or may form part of, a fabric non-apparel element. The mark in the fabric element of the invention is washable using industrial and domestic washing processes without affecting its colour or the fabric element's properties.

The fabric element may be dyed or undyed.

According to a second aspect of the invention, there is provided a method of manufacturing a fabric element comprising a mark formed in or on the surface of the fabric element, the method comprising the steps of:

providing a fabric element comprising a $TiO_2$ additive;

irradiating a region of the surface of the fabric element using a laser so that absorption of laser radiation by the $TiO_2$ in the region causes the laser-irradiated $TiO_2$ to form a lower titanium oxide than $TiO_2$ so as to form the mark in or on the surface of the fabric element, wherein the mark includes the lower titanium oxide.

The features and advantages of the first aspect of the invention and its embodiments apply mutatis mutandis to the features and advantages of the second aspect of the invention and its embodiments.

In the method of the invention, the laser may be a UV laser. The UV laser may be a UVA-wavelength UV laser. The UV laser may be a 355 nm-wavelength UV laser.

In the method of the invention, the laser may be a $CO_2$ laser.

Preferably the $TiO_2$ is exposed to irradiation by the laser under low or zero oxygen conditions when compared to the atmospheric oxygen level at sea level.

In the method of the invention, the mark may include any lower titanium oxide than $TiO_2$, such as $Ti_2O_3$, $Ti_3O_5$ or $Ti_4O_7$.

In the method of the invention, the lower titanium oxide may be infused in fibres of the fabric element.

In the method of the invention, the fabric element may include 0.01 to 5.0 wt % $TiO_2$ additive, preferably 0.25 to 3.0 w % $TiO_2$ additive.

In the method of the invention, the fabric element may be made of a synthetic fabric material. Alternatively the fabric element may be made of a natural fabric material. The fabric element may be woven, non-woven, knit, washable or reusable.

In the method of the invention, the mark may include a letter, a word, a number, a symbol, a picture and/or a graphical element.

In the method of the invention, the fabric element may be rigid, stretchable or elastic.

In the method of the invention, the fabric element may be a label or may form part of a label.

In the method of the invention, the fabric element may be a garment or may form part of a garment. In such embodiments, the fabric element may be a waistband or may form part of a waistband. The fabric element may be, or may form part of, a bra strap, a bra cup, a wrist band, a head band, a shirt or other apparel. Alternatively the fabric element may be, or may form part of, a fabric non-apparel element.

According to a third aspect of the invention, there is provided a fabric element obtainable by a method according to the second aspect of the invention or any one of its embodiments.

The features and advantages of the first and second aspects of the invention and their embodiments apply mutatis mutandis to the features and advantages of the third aspect of the invention and its embodiments.

It will be understood that the term "fabric" in this specification encompasses the term "cloth".

It will also be understood that the fabric element of the invention may include a single mark or a plurality of marks on the surface of the fabric element and that the method of the invention may comprise the formation of a single mark or a plurality of marks (e.g. with different intensities or shades of grey and/or black) on the surface of the fabric element.

It will be appreciated that the use of the terms "first" and "second", and the like, in this patent specification is merely intended to help distinguish between similar features, and is not intended to indicate the relative importance of one feature over another feature, unless otherwise specified.

Within the scope of this application it is expressly intended that the various aspects, embodiments, examples and alternatives set out in the preceding paragraphs, and the claims and/or the following description and drawings, and in particular the individual features thereof, may be taken independently or in any combination. That is, all embodiments and all features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

Preferred embodiments of the invention will now be described, by way of non-limiting examples, with reference to the accompanying drawings in which.

The figures are not necessarily to scale, and certain features and certain views of the figures may be shown exaggerated in scale or in schematic form in the interests of clarity and conciseness.

The following embodiments of the invention are described with reference to manufacture of a garment label and an elastic waistband, but it will be appreciated that the following embodiments of the invention are applicable mutatis mutandis to other types of fabric elements.

Figure 1:
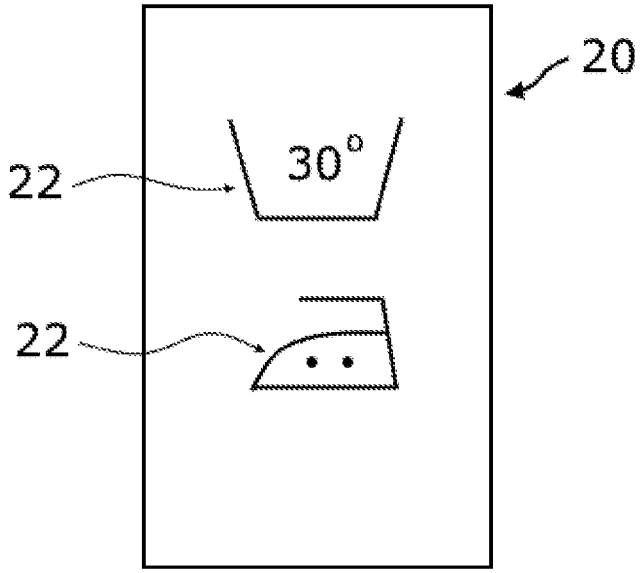
FIG. 1 shows a fabric element according to an embodiment of the invention.

A fabric element according to an embodiment of the invention is shown in FIG. 1 and is designated generally by the reference numeral 20.

The fabric element 20 is a woven jacquard label 20 for attachment to a garment. The label 20 is made of polyester but may be made of another synthetic fabric material, such as nylon. The label 20 comprises a $TiO_2$ additive in an amount preferably ranging from 0.01 to 5.0 wt %. In particular, the $TiO_2$ additive is mixed in a polymer matrix that is used to form synthetic fibres of the label 20, so that the $TiO_2$ additive is infused in the fibres of the label 20.

In the embodiment shown, the label 20 comprises a mark 22 formed on a surface of the label 20. The mark 22 on the label 20 includes cleaning information about the garment to which the label 20 is to be attached. The mark 22 on the label 20 may additionally include product information, manufacturer information and/or manufacturing information.

Figure 2:
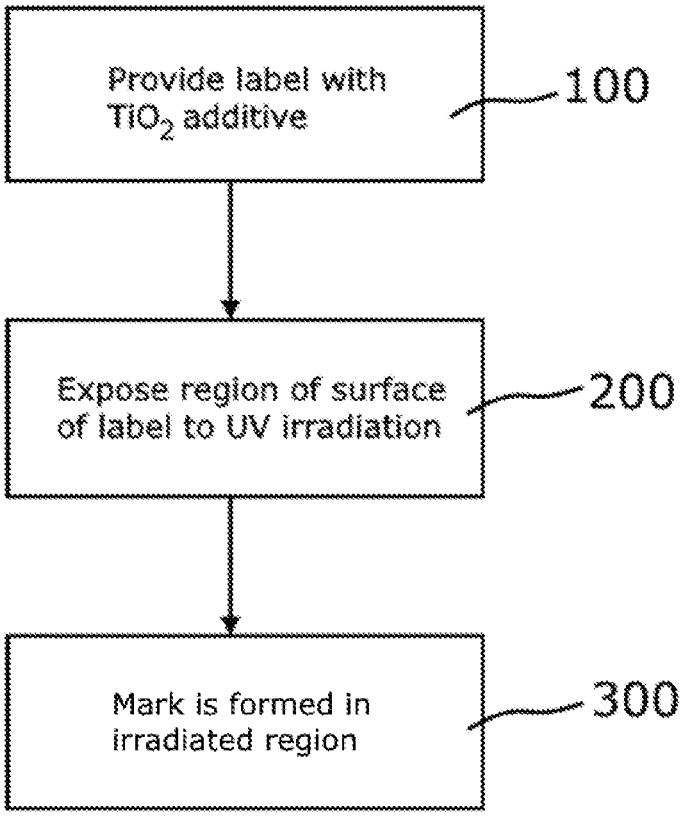
FIGS. 2 and 3 illustrate a fabric element manufacturing method according to an embodiment of the invention.

Referring to FIG. 2, the mark 22 on the label 20 is formed by first providing a label 20 with the $TiO_2$ additive (Step 100) and then irradiating a region of the surface of the label 20 using a 355 nm-wavelength UV laser (Step 200). Other wavelengths in the UVA band may be used. The $TiO_2$ in the region absorbs the UV radiation so that a mark 22 is formed in the irradiated region (Step 300). The infusion of the $TiO_2$ additive in the fibres may create a low/zero oxygen environment when compared to the atmospheric oxygen level at sea level, which upon UV irradiation of the $TiO_2$ produces lower titanium oxides (such as $Ti_2O_3$, $Ti_2O_5$, $Ti_4O_7$) with darker colours, such as shades of black or grey.

Meanwhile the $TiO_2$ outside the irradiated region is not exposed to the UV laser. In this way the UV-irradiated region forms the mark 22 on the surface of the label 20, where the mark is darker than the non-irradiated $TiO_2$ outside the irradiated region. The UV laser is controlled so that the mark 22 is written as the cleaning information.

During the irradiation step, the fabric element may be manipulated to be in a relaxed or stretched state to properly expose the target region for better coloration and consistency of the mark.

Figure 3:
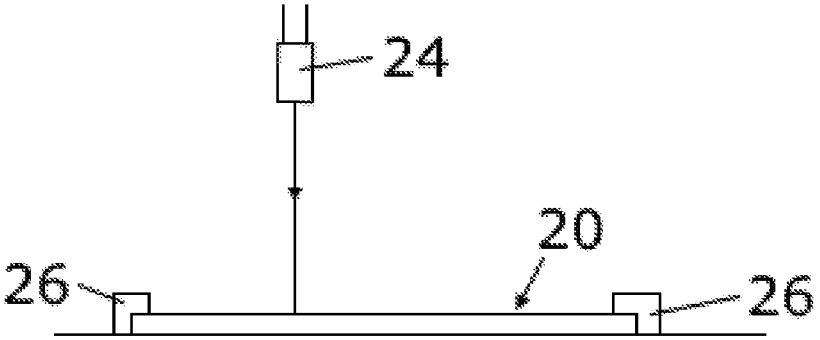

FIG. 3 shows a label printing machine for carrying out a label manufacturing method according to an embodiment of the invention.

The label printing machine comprises a UV laser and a retention device. The retention device is configured to secure the label 20 to prevent its free movement. The UV laser is controllable to irradiate one or more regions of the surface of the label 20 in order to form the mark 22 as described above.

In other embodiments of the invention, the label 20 may be attached to a non-garment product, such as a box or a container.

Figure 4:
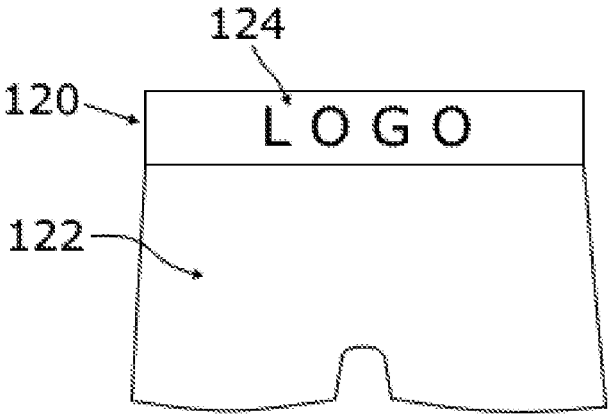
FIG. 4 shows a fabric element according to another embodiment of the invention.

A fabric element according to another embodiment of the invention is shown in FIG. 4 and is designated generally by the reference numeral 120.

The fabric element 120 of FIG. 4 is manufactured in the same way as the fabric element 20 of FIG. 1 except that the fabric element 120 of FIG. 4 is an elastic waistband 120 for forming part of an undergarment 122.

A mark 124 is formed on the surface of the waistband 120 in the same way as a mark 22 is formed on the surface of the label 20 as described above. This enables formation of a readily distinguishable mark 124, such as a logo, on the waistband 120 without significantly damaging the waistband material and negatively affecting its stretchability.

Similarly a mark may be formed on other stretchable or elastic fabric elements.

Figure 5:
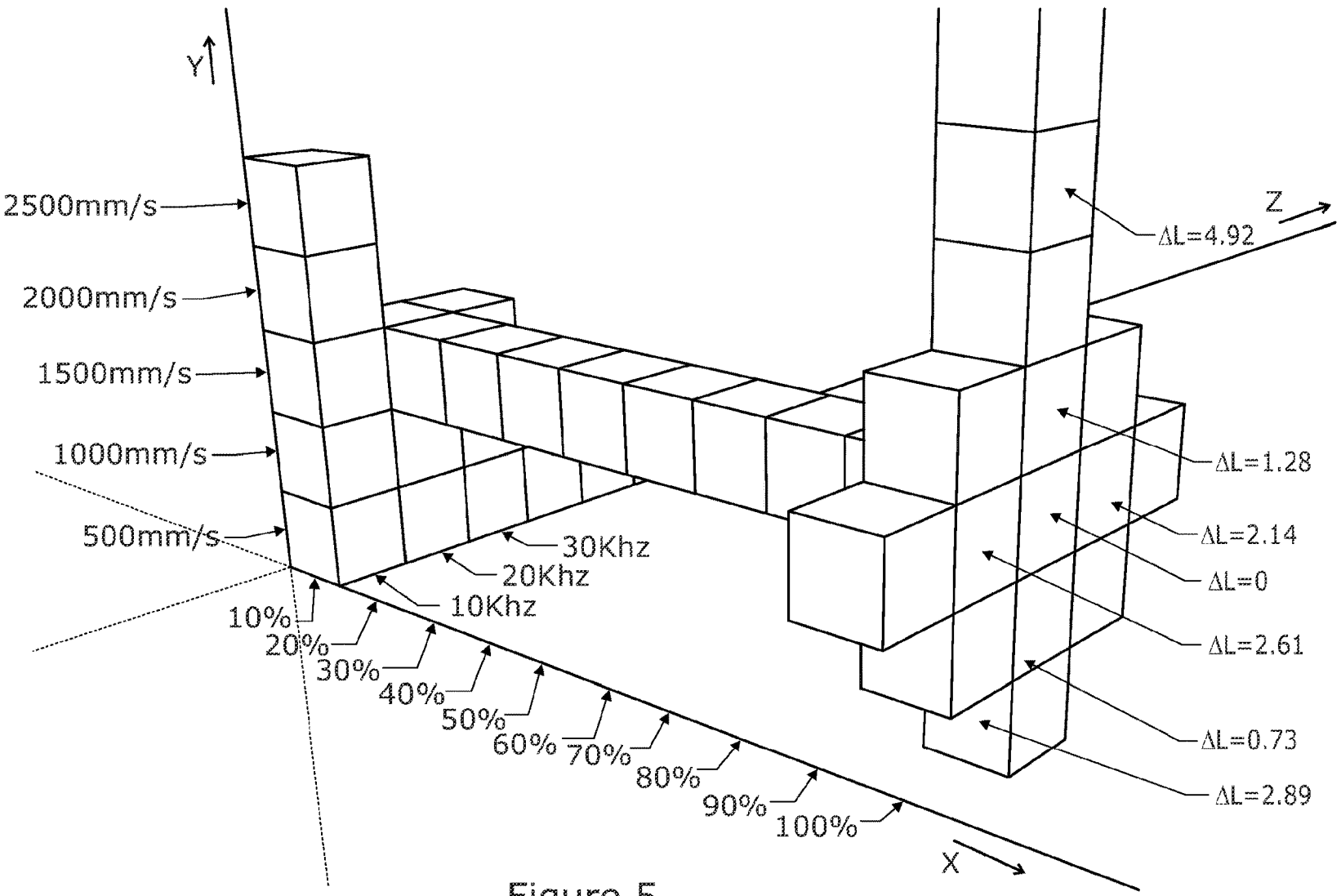

FIG. 5 is a three-dimensional matrix plot of laser output power (X-axis) versus laser moving speed (Y-axis) versus laser pulse frequency (Z-axis). The laser output power at 100% is 5 W. The laser output power affects the energy density of the irradiation. The laser moving speed affects the laser exposure time. As shown in FIG. 5, the three parameters can be adjusted to produce marks 22 of varying shades of grey. Hence, it is possible to customise the mark 22 to have a desired shade of grey.

In FIG. 5, it is shown that the darkest shade of grey (as indicated by $\Delta L=0$) is obtained using a laser moving speed of 1500 mm/s, a laser pulse frequency of 20 kHz and a laser output power of 5 W at 100%. "ΔL" represents a lightness difference between the actual sample and a control sample. The shade of grey of the mark 22 can be made lighter by changing the laser moving speed, the laser pulse frequency and the laser output.

In other embodiments of the invention, it is envisaged that the UV laser may be replaced by a different type of laser, such as a $CO_2$ laser.

It will be appreciated that the above numerical values are merely intended to help illustrate the working of the invention and may vary depending on the requirements of the fabric element and its manufacture.

The listing or discussion of an apparently prior-published document or apparently prior-published information in this specification should not necessarily be taken as an acknowledgement that the document or information is part of the state of the art or is common general knowledge.

Preferences and options for a given aspect, feature or parameter of the invention should, unless the context indicates otherwise, be regarded as having been disclosed in combination with any and all preferences and options for all other aspects, features and parameters of the invention.

The invention claimed is:

1. A fabric element comprising a $TiO_2$ additive, the fabric element including a mark formed in a surface of the fabric element, wherein the mark includes a lower titanium oxide than $TiO_2$, wherein the lower titanium oxide of the mark is infused in fibres of the fabric element.

2. The fabric element according to claim 1 wherein the mark includes $Ti_2O_3$, $Ti_3O_5$ or $Ti_4O_7$.

3. The fabric element according to claim 1 wherein the fabric element includes 0.01 to 5.0 wt % $TiO_2$ additive.

4. The fabric element according to claim 1 wherein the mark includes a letter, a word, a number, a symbol, a picture and/or a graphical element.

5. The fabric element according to claim 1 wherein the fabric element is rigid.

6. The fabric element according to claim 1 wherein the fabric element is stretchable or elastic.

7. The fabric element according to claim 1 wherein the fabric element is at least one of (a) a label or forms part of a label, (b) a garment or forms part of a garment, or (c) a waistband or forms part of a waistband.

8. The fabric element according to claim 1 wherein the fabric element is dyed.

* * * * *